US007903987B2

(12) United States Patent
Matsushita et al.

(10) Patent No.: US 7,903,987 B2
(45) Date of Patent: Mar. 8, 2011

(54) IMAGE FORMING APPARATUS AND CONTROL METHOD THEREFOR

(75) Inventors: Makoto Matsushita, Osaka (JP); Yoshie Tsuchida, Osaka (JP); Takeshi Yamashita, Osaka (JP)

(73) Assignee: Ricoh Company Limited, Tokyo (JP)

( * ) Notice: Subject to any disclaimer, the term of this patent is extended or adjusted under 35 U.S.C. 154(b) by 39 days.

(21) Appl. No.: 12/437,906

(22) Filed: May 8, 2009

(65) Prior Publication Data

US 2009/0279909 A1 Nov. 12, 2009

(30) Foreign Application Priority Data

May 9, 2008 (JP) ..... 2008-123706

(51) Int. Cl.
*G03G 15/00* (2006.01)

(52) U.S. Cl. ..... 399/45

(58) Field of Classification Search ..... 399/45, 399/51, 66; 347/139
See application file for complete search history.

(56) References Cited

U.S. PATENT DOCUMENTS

| | | | | |
|---|---|---|---|---|
| 6,301,452 | B1 * | 10/2001 | Yoshizawa | 399/45 |
| 2005/0280687 | A1 * | 12/2005 | Kurahashi | 347/139 |
| 2008/0226313 | A1 | 9/2008 | Tsuchida et al. | |
| 2009/0060540 | A1 | 3/2009 | Matsushita et al. | |

FOREIGN PATENT DOCUMENTS

| | | |
|---|---|---|
| JP | 7-21679 | 3/1995 |
| JP | 8-36329 | 2/1996 |
| JP | 3080328 | 6/2000 |
| JP | 2001-312159 | 11/2001 |
| JP | 3517621 | 1/2004 |
| JP | 3553211 | 5/2004 |
| JP | 2004-258397 | 9/2004 |
| JP | 2007-304492 | 11/2007 |

* cited by examiner

*Primary Examiner* — Hoang Ngo

(74) *Attorney, Agent, or Firm* — Oblon, Spivak, McClelland, Maier & Neustadt, L.L.P.

(57) ABSTRACT

An image forming apparatus includes an exposure mechanism to form a latent image by exposure, a latent-image carrier to hold the latent image, a charging mechanism to charge the latent-image carrier evenly, a development device to develop a latent image on the latent-image carrier into a toner image, a transfer mechanism to transfer the toner image formed on the latent-image carrier onto a transfer material, at least one asperity profile reading mechanism to read an asperity of an entire image area of the transfer material at least in a width direction thereof onto which a toner image is to be transferred, and a control mechanism to adjust a toner adhesion amount of the toner image transferred to the transfer material in accordance with a localized asperity of a surface of the transfer material read by the asperity profile reading mechanism.

17 Claims, 8 Drawing Sheets

IMAGE FORMING APPARATUS AND CONTROL METHOD THEREFOR

CROSS-REFERENCE TO RELATED APPLICATIONS

This patent specification claims priority from Japanese Patent Application No. 2008-123706, filed on May 9, 2008 in the Japan Patent Office, the entire contents of which are hereby incorporated by reference herein.

BACKGROUND OF THE INVENTION

1. Field of the Invention

The present invention relates to an image forming apparatus such as a copier, a printer, and a facsimile machine, and more particularly, to an electrophotographic image forming apparatus.

2. Discussion of the Background

Various types of transfer materials, such as copy sheets, are used in an image forming apparatus such as a copier, a printer, a facsimile machine, and the like. Depending on the purpose of image formation, a transfer material that has a rough surface, that is, having surface asperities, is sometimes preferred.

However, when such a rough-surfaced transfer material (hereinafter "rough material") is used for printing, there is a possibility that an image formed thereon might be disturbed during the transfer process, which is a process of transferring a toner image onto the transfer material.

In particular, where the surface asperities are relatively significant, in a concavity, a gap is present between the transfer material and the toner image that is formed on the toner image carrier that carries the toner image, such as a photoreceptor and an intermediate transfer belt, destabilizing a transfer electric field and resulting in image failure, such as a white void in which toner is partly absent, inconsistencies in lightness, and image density unevenness.

FIGS. 10A and 10B are schematic views illustrating an area surrounding a concavity in the surface of the rough material when a filled-in image or solid image patch is transferred from the image carrier to the transfer material using a known image forming apparatus. FIG. 10A shows a state before the transfer process and FIG. 10B shows a state after the transfer process.

Referring to FIGS. 10A and 10B, it can be seen that when rough material, such as Japanese paper, is used for printing, the transfer electric field cannot be formed sufficiently because of the gap created by the concavity.

In other words, because an electric charge applied from a back surface of the transfer material by the transfer bias is too far from the toner image due to the gap, the toner image carried by the image carrier cannot be sufficiently attracted by electrostatic force to the front surface of the transfer material. Therefore, substandard images, such as images whose image density is uneven, are the result.

Several approaches described below have been proposed to prevent such image failure.

In one known image forming apparatus, an image carrier such as an intermediate transfer belt is vibrated by ultrasound to weaken adhesion between the toner and the image carrier so that the image can be transferred to the transfer material even if the electric field is unstable in the gap portion.

However, in such an image forming apparatus including a vibration member, vibration noise is generated, which can annoy users. Additionally, the vibration tends to shorten the working life of other members such as the image carrier.

In another known image forming apparatus, to print high quality multicolor images, the image carrier such as an intermediate transfer belt includes an elastic layer, and its surface that carries toner is designed to have a surface micro hardness within a predetermined range to follow the asperities in the surface of the recording medium, thus reducing the gap.

However, in this known image forming apparatus, the cost of forming the elastic layer on the image carrier is relatively high. Further, this configuration cannot accommodate tiny gaps.

In another known method, the image forming apparatus is a direct transfer type. The image forming apparatus includes an information acquisition mechanism that acquires information related to a surface structure of the transfer material, and a control mechanism that varies the degree of toner adhesion depending on the degree of surface roughness of the transfer material. Then, when a sheet reading mechanism in the information acquisition mechanism detects that the sheet has a rough surface, the control mechanism increases a transfer bias that is applied to a transfer nip during the transfer process by the control mechanism so as to increase the amount of the toner adhering to the sheet.

However, in this known image forming apparatus, although the sheet reading mechanism judges whether the surface of the sheet is rough or smooth, the judgment is made in accordance with the entire surface of transfer material, and adhesion is adjusted by varying the transfer bias.

Therefore, because this mechanism does not adjust the toner adhesion amount in accordance with localized concavities of the surface of the sheet, the overall color reproducibility has a problem, and the solid shaded areas and halftone are not balanced.

Additionally, because the toner adhesion amount is increased for the entire transfer material, the developer is consumed in excess, which is inefficient.

SUMMARY OF THE INVENTION

In view of the foregoing, one illustrative embodiment of the present invention provides an image forming apparatus that includes an exposure mechanism to form a latent image by exposure, a latent-image carrier that carries the latent image, a charging mechanism to charge the latent-image carrier evenly, a development device that develops a latent image on the latent-image carrier into a toner image, a transfer mechanism that transfers the toner image formed on the latent-image carrier onto a transfer material, at least one asperity profile reading mechanism that reads an asperity of an entire image area of the transfer material at least in a width direction of the transfer material onto which a toner image is to be transferred, and a control mechanism that adjusts a toner adhesion amount of the toner image transferred to the transfer material in accordance with a localized asperity of a surface of the transfer material read by the asperity profile reading mechanism.

In view of the foregoing, one illustrative embodiment of the present invention provides a control method for an image forming apparatus including an asperity profile reading mechanism, a storage mechanism, and a calculating mechanism. The control method includes reading an asperity profile of a transfer material at least in a width direction of a transfer material onto which a toner image is to be transferred, and adjusting a toner adhesion amount of the toner image transferred to the transfer material in accordance with a localized asperity in the asperity profile of a surface of the transfer material.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
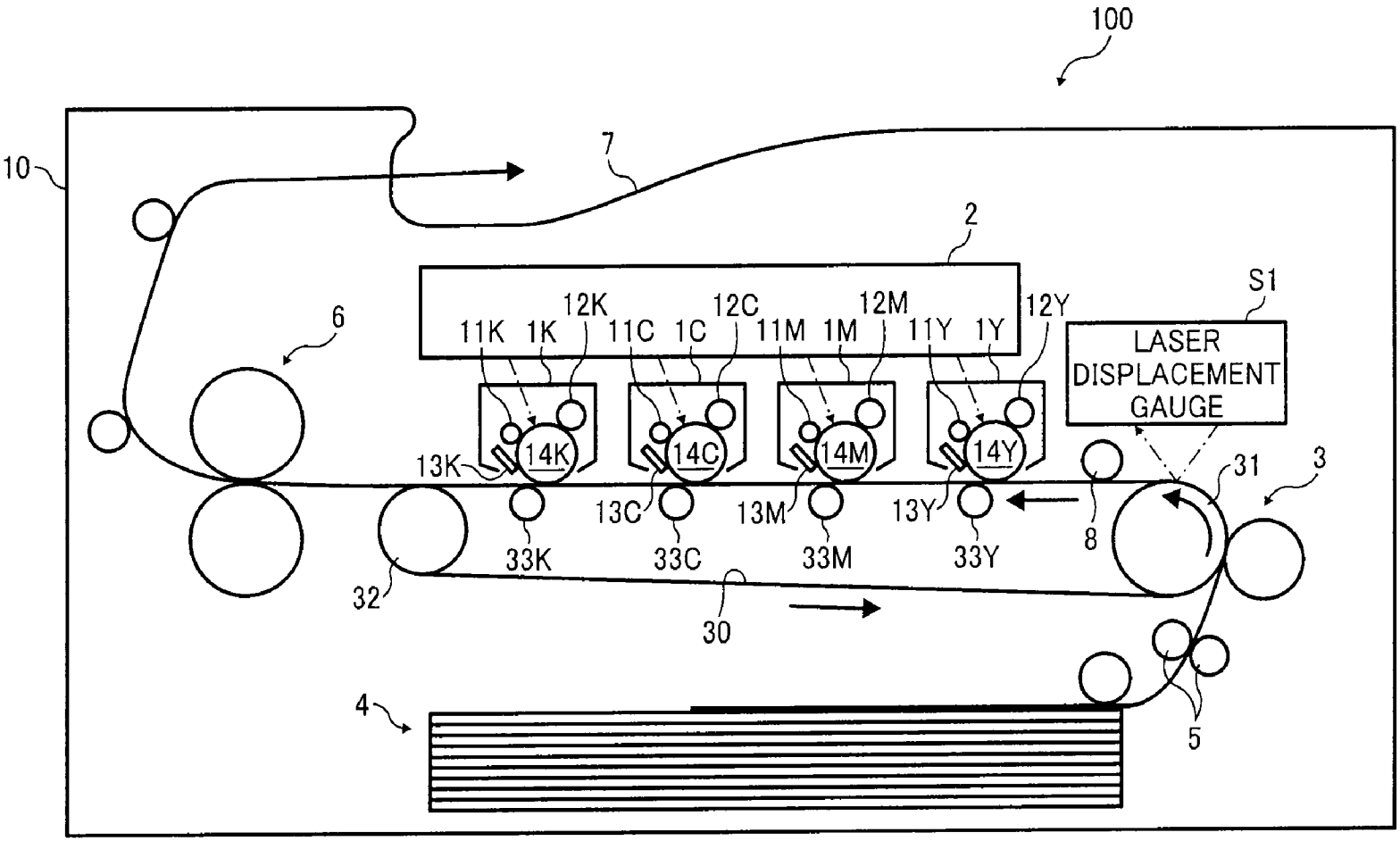
FIG. 1 is a schematic diagram illustrating a configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIG. 1, an image forming apparatus according to an example embodiment of the present invention is described below.

It is to be noted that although the image forming apparatus of the present embodiment is a printer, the image forming apparatus of the present invention is not limited to a printer.

(Configuration of Image Forming Apparatus)

FIG. 1 is a schematic diagram illustrating a configuration of the image forming apparatus.

In FIG. 1, reference numeral 100 indicates a quadruplet tandem-type multicolor printer (hereinafter "color printer"), including four color toners, yellow, magenta, cyan, and black, as an example of the image forming apparatus according to the present embodiment.

The color printer 100 includes four process cartridges 1Y, 1M, 1C, and 1K as image forming units for forming single-color toner images corresponding to respective colors of the toner.

The process cartridges 1Y, 1M, 1C, and 1K are arranged in that order in a direction (hereinafter "sheet transport direction" or "sub-scanning direction") in which a transport belt 30 transports a transfer material such as a sheet of paper, overhead projector (OHP) film, or the like. The process cartridges 1Y, 1M, 1C, and 1K and are detachably attached to a main body 10 of the image forming apparatus.

The process cartridges 1Y, 1M, 1C, and 1K each include photoreceptor drums 14Y, 14M, 14C, and 14K, charging members 11Y, 11M, 11C, and 11K, development devices 12Y, 12M, 12C, and 12K, and cleaning members 13Y, 13M, 13C, and 13K, respectively.

It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

The photoreceptor drums 14 are located in center portions of the respective process cartridges 1.

The charging devices 11 electrically charge outer circumferences of the respective photoreceptor drums 14 uniformly.

The development devices 12 supply the toners to electrostatic latent images held on the outer circumferences of the respective photoreceptor drums 14 in a develop process.

The cleaning members 13 remove residual toner adhering to the outer circumferences of the respective photoreceptor drums 14 after the transfer process.

An optical unit 2 is located above the process cartridges 1. The optical unit 2 irradiates the process cartridges 1 with laser beams (exposure light), and the photoreceptor drums 14 that have been electrically charged uniformly by the charging members 11 are selectively exposed. Thus, the optical unit 2 that serves as an exposure device writes electrostatic latent images on the photoreceptor drums 14.

The optical unit 2 includes a laser light source, not shown, that can vary an amount of the exposure light. The laser light source can vary an output amount of the laser beam among at least two power levels, a normal power for example, 150 μW, and a high power, for example, 250 μW, for concavities. Alternatively, instead of varying the power output of a single light source, the laser light source can include multiple laser light sources whose power levels are different, and the optical unit 2 may be configured so as to be able to switch between the multiple power levels.

Additionally, a direct transfer-type transfer-transport unit 3 is located beneath the process cartridges 1. The transfer-transport unit 3 transfers the toner images from the photoreceptor drums 14 onto the transfer material while transporting the transfer material in synchronization with operations of the process cartridges 1 so that single-color toner images formed by each process cartridge 1 are superimposed one on another on the transfer material into a multicolor toner image.

The transfer-transport unit 3 includes the transport belt 30 that is a seamless belt and transports the transfer material while carrying it on its outer circumferential surface, a driving roller 31 that drives the transport belt 30 to rotate, and a driven roller 32 driven by the driving roller 31.

Four transfer rollers 33Y, 33M, 33C, and 33K that are contact-type transfer bias members are located inside the transport belt 30 and face the photoreceptor drums 14Y, 14M, 14C, and 14K of the respective process cartridges 1. Each of the transfer rollers 33Y, 33M, 33C, and 33K contacts an inner circumferential surface of the transport belt 30.

Then, the transfer material applies a transfer bias whose polarity is the opposite of that of the toner image to the transfer material via the transfer belt 30.

As a result, the respective color toner image are sequentially transferred from the respective photoreceptor drums 14Y, 14M, 14C, and 14K, serving as image carriers, to the transfer material with an effect of electrostatic force.

The multicolor printer 100 further includes a sheet feeder 4, a pair of registration rollers 5, a fixing device 6, a discharge sheet tray 7, and a cleaning roller 8.

The sheet feeder 4 contains the transfer materials such as copy sheets of a predetermined size, and feeds the transfer materials one by one. The transfer material fed from the sheet feeder 4 is transported by the registration roller 5 in synchronization with the transferring timing of the transfer-transport device 3. The fixing device 6 fixes the image on the transfer material by applying heat and pressure. The transfer material on which the toner image is fixed is discharged and stacked on the discharge sheet tray 7. The cleaning roller 8 removes paper powder and toner stains adhered to the transport belt 30.

The multicolor printer 100 further includes a laser displacement gauge S1, serving as an asperity profile reading mechanism, to measure surface roughness of the transfer material, and a controller 15 to control respective portions of the multicolor printer 100.

(Image Formation)

Image forming operations of the multicolor printer 100 are described below with reference to FIG. 1.

In each process cartridge 1, the photoreceptor drum 14 is driven to rotate clockwise in FIG. 1, and the outer circumference of the photoreceptor drum 14 is electrically charged evenly by the charging member 11.

When the photoreceptor drum 14 rotates a little, the photoreceptor drum 14 is irradiated with the laser light emitted from the optical unit 2 based on the image information, and thus, a surface electric potential of the irradiated part of the photoreceptor drum 14 is changed. That is, the photoreceptor drum 14 is exposed, and thus an electrostatic latent image is formed thereon.

As the photoreceptor drum 14 further rotates, a development bias is applied thereto by the development device 12, transferring the toner that is electrically charged to a predetermined polarity from a development roller, not shown, provided in the development device 12 to the electrostatic latent image. Thus, the latent image is developed, that is, a single-color toner image is formed on the photoreceptor drum 14.

While the toner image is thus formed in each process cartridge 1, the sheet feeder 4 feeds the transfer materials one by one, and the pair of registration rollers 5 adjusts a timing of forwarding the transfer material to the transport belt 30. Then, the transfer material is transported by the transport belt 30 in a clockwise direction toward transfer nips formed between the transport belt 30 and the respective process cartridges 1.

In the transfer nips, the transfer bias is applied to the transfer material from the transfer rollers 33, and then, the toner image formed by the process cartridges 1 is transferred from the photoreceptor drums 14 and superimposed one on another on the transfer material.

The transfer material onto which the toner image is thus transferred is further transported to the fixing device 6, where heat and pressure are applied to the transfer material so that the toner image is fused on and adheres to the transfer material, and thus the image is fixed on the transfer material.

The paper powder and the toner adhering to the transport belt 30 is cleaned by the cleaning roller 8, and any toner adhering to the photoreceptor drums 14 after the transfer process is removed by the respective cleaning members 13 as preparation for subsequent image formation.

(Reading an Asperity Profile)

Next, an asperity profile reading mechanism that is a distinctive feature of the present invention is described below with reference to FIGS. 2 through 4.

Figure 2:
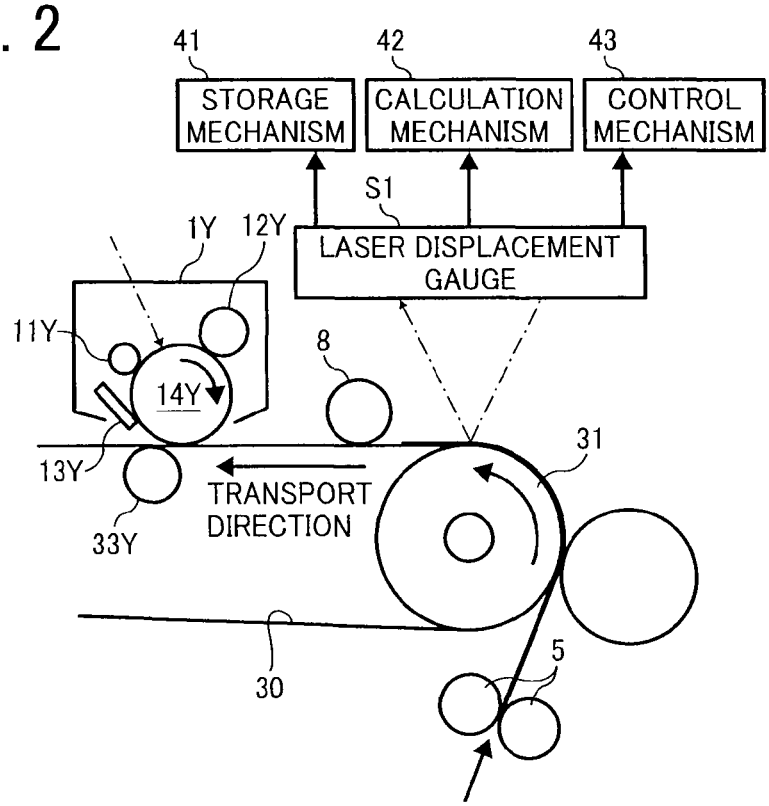
FIG. 2 is a diagram illustrating a location of a laser displacement gauge that is one example of an asperity profile reading mechanism.
Figure 3:
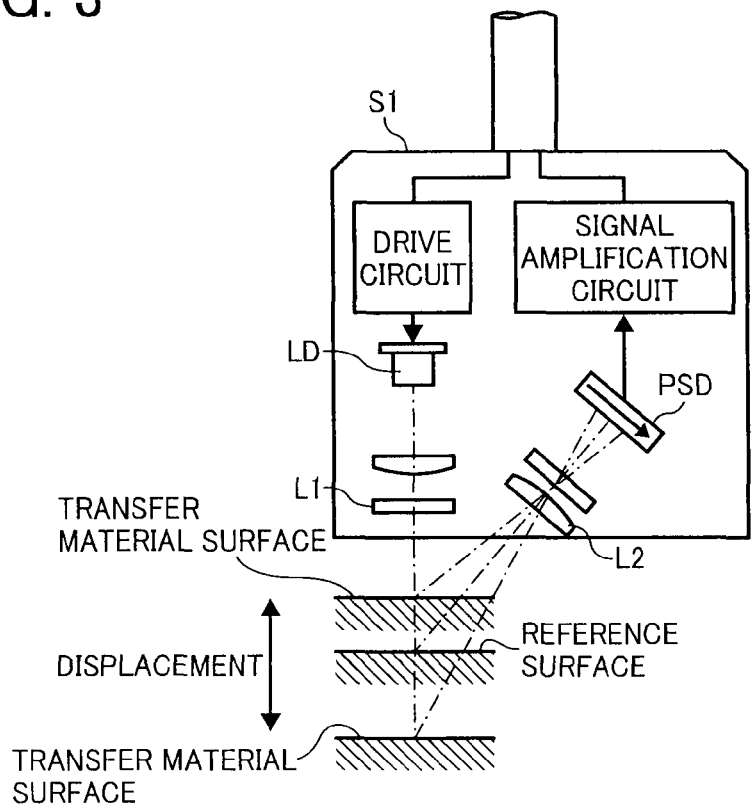
FIG. 3 illustrates a configuration of the laser displacement gauge shown in FIG. 2.
Figure 4:
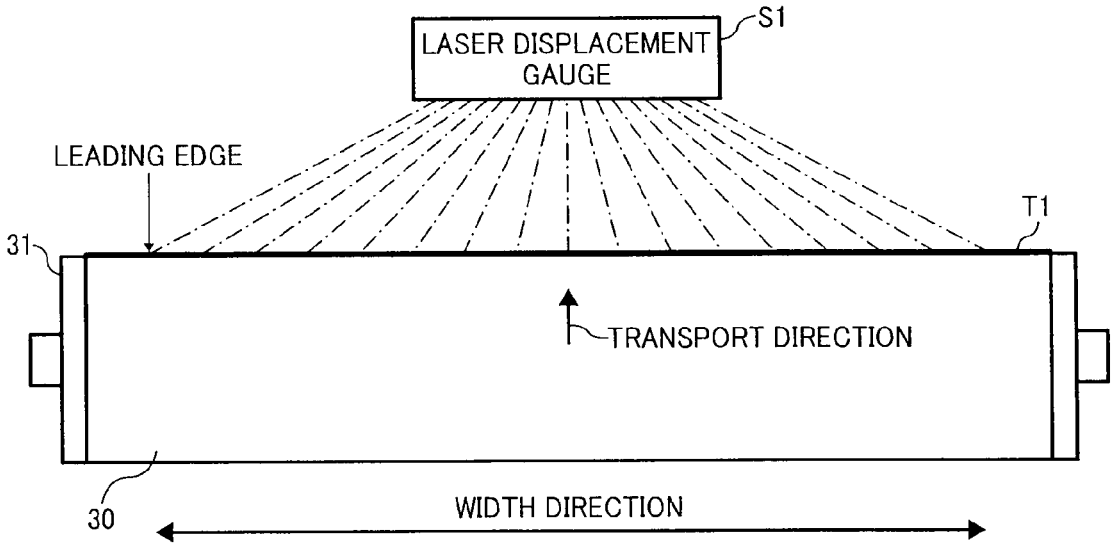
FIG. 4 illustrates a main scanning direction of the laser displacement gauge.

FIG. 2 illustrates a location of the laser displacement gauge S1 that is one example of the asperity profile reading mechanism, FIG. 3 illustrates a configuration of the laser displacement gauge S1 shown in FIG. 2, and FIG. 4 illustrates a main scanning direction of the laser displacement gauge S1.

The laser displacement gauge S1 (for example, LG-G080 manufactured by KEYENCE) is a dispersion-reflection-type optical sensor to measure two-dimensional triangular distance as the asperity profile reading mechanism.

Referring to FIG. 2, the laser displacement gauge S1 can direct a laser beam toward a portion of the transport belt 30 wound around an outer circumference of the driving roller 31 so as to scan a surface of the transfer material when the transfer material carried on the transfer belt 30 passes the driving roller 31.

This configuration allows the laser light to scan the transfer material disposed on the driving roller 31 via the transport belt 30, thereby reducing measurement error caused by vibration of the transfer belt 30.

The portion of the transfer material toward which the laser displacement gauge S1 directs the laser light is not limited to the driving roller 31, and alternatively, the laser displacement gauge S1 can direct the laser light toward the driven roller 32 located in an upper portion in the direction in which the surface of transport belt 30 moves (sheet transport direction). Additionally, multiple laser lights can be disposed in accordance with the width of measuring transfer material and the measuring range of the displacement gauge S1.

It is preferable that the position of the laser displacement gauge S1 that measures the surface asperities of the transfer material (hereinafter "measuring position") is set to meet the requirement described below.

It is assumed that a first time period means a time period from when the optical unit 2 emits the laser light to write the electrostatic latent image on the photoreceptor drum 14Y, after which the latent image is developed into a toner image until the toner image is transported to the transfer nip, and a second time period means a time period required for the transport belt 30 to carry the measured position on the transfer material to the transfer nip.

In order to secure sufficient time for computation and control described below, the second period should be sufficiently longer than the first period. To set the second time period longer than the first time period, the measuring position of the laser displacement gauge S1 and a transport speed of the transport belt 30, that is, circumferential velocity, should be set so that a sufficiently long distance is maintained between the measuring position of the laser displacement gauge S1 and the transfer nip of the process cartridge 1Y located at an extreme upstream position.

Referring to FIG. 3, the laser displacement gauge S1 includes a semiconductor laser LD that is a light-emitting element as a laser light source, and a position sensitive detector PSD that is a line sensor as a light-receiving element.

In the laser displacement gauge S1, the semiconductor laser LD emits red light whose wavelength is 650 mm, and its maxim output power level is 0.95 mW.

The light is focused through a floodlight lens L1 and is directed onto the surface of the transfer material, and then, a part of light ray reflected diffusionally by the asperity of the surface thereof is focused as a light spot on the position sensitive detector PSD through the receiving light lens L2.

The laser displacement gauge S1 is designed to measure asperity profile of the transfer material based on the position of the light spot and to output the asperity profile in a predetermined or given cycle of, for example, 3.8 ms.

Further, because the laser displacement gauge S1 is connected to a storage mechanism 41 such as a memory, a calculation mechanism 42 to perform predetermined calculation, and a control mechanism 43 to control the adhesion amount of the toner, and the like, various types of control can be performed based on feedback of the asperity profile from the laser displacement gauge S1.

FIG. 4 is a diagram illustrating the laser displacement gauge S1 and a transfer material measured thereby viewed from the right in FIG. 2, and a width direction of the transfer material (main scanning direction) is in a horizontal direction in FIG. 4.

A measurement range that the laser displacement gauge S1 can measure at a single time is an entire area in the main scanning direction shown in FIG. 4, which means an entire image area in the width direction of the transfer material, that is, an entire area in which an image can be formed in the direction orthogonal to the sheet transport direction.

At the same time, the sheet transport direction parallels the sub-scanning direction.

As described above, because the laser displacement gauge S1 outputs the asperity profile for the entire image area in the main scanning direction of the transfer material in the predetermined cycle, the asperity profile in the sub-scanning direction is measured for each predetermined or given distance the transport belt 30 carries the transfer material.

Therefore, in order to improve the accuracy of position detection of the concavities on the transfer material, the transport velocity of the transport belt 30, that is, a peripheral velocity of the driving roller 31, is preferably slower to increase the measuring number, that is, the number of positions on the transfer material that are measured by the laser displacement gauge S1.

For example, when the transfer material whose surface is rough (hereinafter "rough material") such as Japanese paper is used for the transfer material, it is preferable that the transfer velocity with which the transport belt 30 transports the transfer material is slower.

Further, the transport velocity with which the transfer material is transported can be preset in accordance with the degree of asperity of the transfer material as appropriate, and the transport velocity of the transfer material can be determined according to the feedback of the asperity profile.

For example, a parameter showing surface roughness of the transfer material can be calculated based on the profile of the surface asperities, and the transport velocity determined in accordance with the parameter.

In the multicolor printer 100, the calculation mechanism shown in FIG. 2 calculates the asperity profile of the transfer material through a predetermined or given method, and then, the toner adhesion amount is adjusted by changing the exposure condition based on feedback of the asperity profile. Additionally, it is more preferable that the laser displacement gauge S1 also serve as a leading edge position detector that detects the leading end position of the transfer material. Accordingly, because the position of the transfer material can be detected relatively accurately, images can be transferred onto transfer materials without positional displacement even if the transfer materials have concavities. Further, such an arrangement means that the printer 100 does not need a separate leading edge position detector, and therefore the cost can be reduced.

(The Asperity Profile)

Subsequently, profile information about the surface asperities (the asperity profile) is described below using an experiment in which the laser displacement gauge S1 reads an A4-sized sheet of wavy Japanese paper, Sazanami, manufactured by Ricoh (hereinafter "A4-sized Japanese sheet").

Figure 5A:
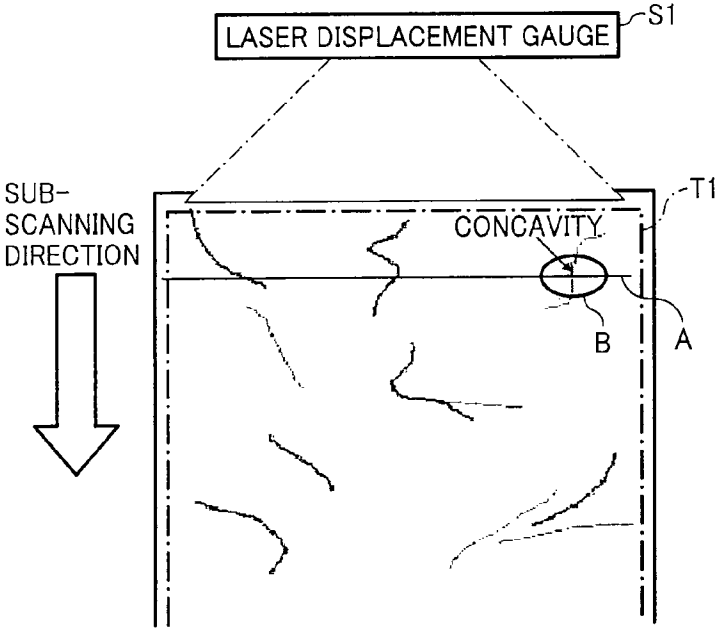
FIG. 5A illustrates a situation in which an A4-sized sheet of Japanese paper is read by the laser displacement gauge shown in FIG. 2.
Figure 5B:
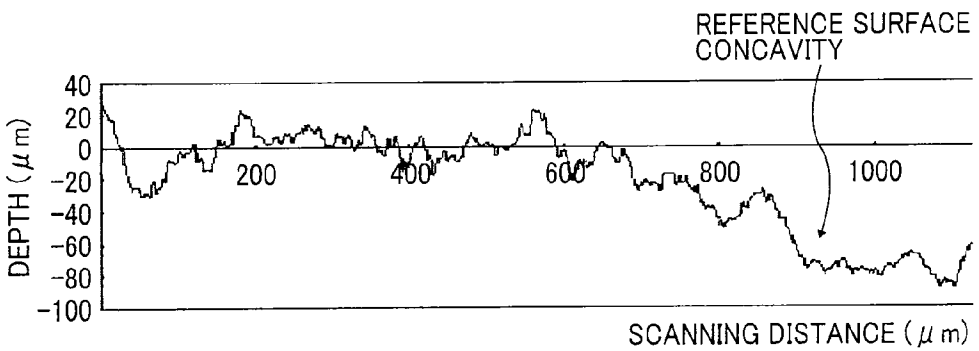
FIG. 5B is a graph illustrating a cross-sectional profile showing a surface roughness as one example of an asperity profile read by the laser displacement gauge.

FIG. 5A illustrates reading of the surface asperities of the A4-sized Japanese sheet by the laser displacement gauge S1. FIG. 5B is a graph illustrating a cross-sectional profile showing a surface roughness as one example of the asperity profile read by the laser displacement gauge S1.

In FIG. 5A, reference character T1 represents the transfer material (A4-sized Japanese sheet) as one example of the rough material having large asperities.

Gray parts on the A4-sized Japanese sheet T1 represent grooves, that is, relatively deep concavities among wrinkles on the A4-sized Japanese sheet, whose width range is 0.1 mm through 0.3 mm and depth range is 10 μm through 100 μm.

An area surrounded by alternating long and short dashed line indicates the image area to which an image can be transferred.

Referring to FIG. 5A, the laser displacement gauge S1 measured the asperities as the asperity profile in an area indicated by line A from one end to the other at a time to obtain the cross-sectional profile shown in FIG. 5B.

FIG. 5B shows enlarged diagram illustrating a portion of the cross-sectional profile as the asperity profile of only an elliptical area B shown in FIG. 5A. It is to be noted that the asperity profile in the present embodiment means data obtained by reading surface asperities both in the main scanning direction and in the sub-scanning direction.

In FIG. 5B, a vertical axis shows a depth of measured profiles of the surface asperities in μm and a horizontal axis shows the scanning distance in μm.

In FIG. 5B, depth 0 on the vertical axis means that a distance between a measured point and the laser displacement gauge S1 is identical or similar to a distance between a measurement reference point (reference surface) and the laser displacement gauge S1.

A plus (+) area of the profile data means that the measure portion of the surface of the A4-sized Japanese sheet projects upward from the reference point, which is closer to the laser displacement gauge S1 than the reference point is. A minus (−) area of the profile data means that the measured portion of the surface of the A4-sized Japanese sheet is concaved from the reference point, which is farther from the laser displacement gauge S1 than the reference point is.

In FIG. 5B, a horizontal axis indicates the distance in μm from the reference point in the main scanning direction, that is, the position where the asperity profile is obtained in the width direction of the transfer material.

Subsequently, a position determination process to determine position of the concavities on the transfer material is described below.

(1) Measurement of Surface Asperities in the Main Scanning Direction

Initially, the laser displacement gauge S1 reads the asperity profile in the width direction of the entire image area of the transfer material at a time instantly, and thus, the cross-sectional profile, that is, a roughness profile, is obtained, and which is stored in the storage mechanism 41.

(2) Calculation of a Mean Value of Depths in the Main Scanning Direction

Subsequently, the calculation mechanism 42 calculates the mean value of depths of the surface asperities (hereinafter "depth mean value") from the asperity profile, and the depth mean value serves as a reference surface, that is, an average line of the transfer material.

(3) Determination of Position of the Concavities

Portions that are deep position over a predetermined amount (for example, 40 μm), which are the portions farther from the laser displacement gauge S1 than the reference surface, are deemed concavities.

(4) Movement of the Transfer Material in the Sub-Scanning Direction

Processes (1) through (3) described above are performed after the transfer material is moved a predetermined distance in the sub-scanning direction. In other words, the above-described processes (1) through (3) are repeated each time a predetermined period has elapsed while the transport belt 30 holding the transfer material is rotated by driving the driving roller 31.

Regarding the predetermined distance for which the transfer material is transported in the sub-scanning direction, when a radius of one dot is within a range from 40 μm to 90 μm, the predetermined distance in the sub-scanning direction is preferably smaller than the radius of one dot.

On the other hand, when the predetermined distance is smaller than a radius of a toner particle, the data amount increases to such an extent that inconveniences, for example, a longer calculation time is required, arise, reducing productivity.

Preferably, the radius of toner particle≦predetermined distance in the sub-scanning direction≦the radius of one dot.

By repeating the above-described operation until a trailing edge portion of the image area of the transfer material in the sheet transport direction is read by the laser displacement gauge S1, the position of the concavities can be detected while the asperity profile in the entire image area of the transport material can be obtained.

(Control of Adhesion Amount of Toner in Accordance With Localized Asperities)

The control of the toner adhesion amount in accordance with localized asperities is described below.

In general, as for a method of controlling the toner adhesion amount, in an example method, exposure amount is varied by varying the electric voltage or electric current of the development mechanism and/or the electrostatic charging mechanism. In another example method, the toner adhesion amount is adjusted by varying the power of a laser light source, an irradiation time, that is, the duty cycle, of the laser light, and/or a wavelength of the laser light of the optical unit.

The multicolor printer 100 in the present embodiment adopts the method including varying the power of the laser light of the optical unit 2 to control the adhesion amount of the toner because, in this method, control of the adhesion amount of the toner in accordance with the localized asperities of the surface of the transfer material is relatively easy.

In fact, the image forming apparatus according to the present embodiment is designed to increase the toner adhesion amount by changing the power level of the laser source from a normal power level (for example, 150 μW) to a higher power level that is used for the concavities (for example, 250 μW) which the reading mechanism of the asperity profile (laser displacement gauge Si) determines as the concavities.

"To increase the toner adhesion amount" means to increase the laser power for the concavities above that for other, non-concavity portions, in a case in which the toner adhesion amount is identical to or similar between the concavities and other portions with respect to a target toner adhesion amount used when image density is adjusted using a test patch pattern.

In short, when similar images are formed in the concavities and in the other portions, the toner adhesion amount in the concavities is relatively increased.

Naturally, depending on the image to be formed, when it is not necessary to form image such as a letter or a line in concavities, the toner is not adhered to those concavities. Further, when a thin image such as a slight line is to be formed in concavities, the toner adhesion amount in concavities is lower than the other portions.

(Mechanism to Inhibit Occurrence of Substandard Images by Increasing the Toner Adhesion Amount.)

The mechanism to inhibit image failure by increasing the toner adhesion amount is described below.

Figure 6A:
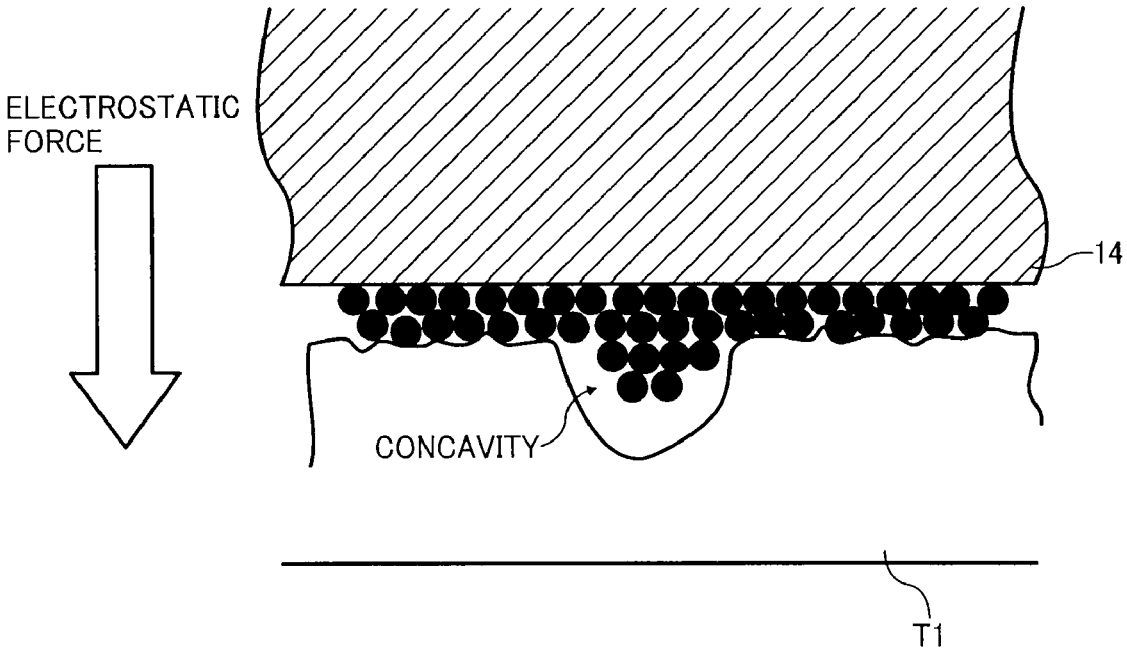
FIG. 6A is a schematic view illustrating a state of portions near concavities of the transfer sheet and a photoreceptor drum just before a patch of a filled-in image is transferred from the photoreceptor drum onto the transfer sheet in the image forming apparatus shown in FIG. 1.
Figure 6B:
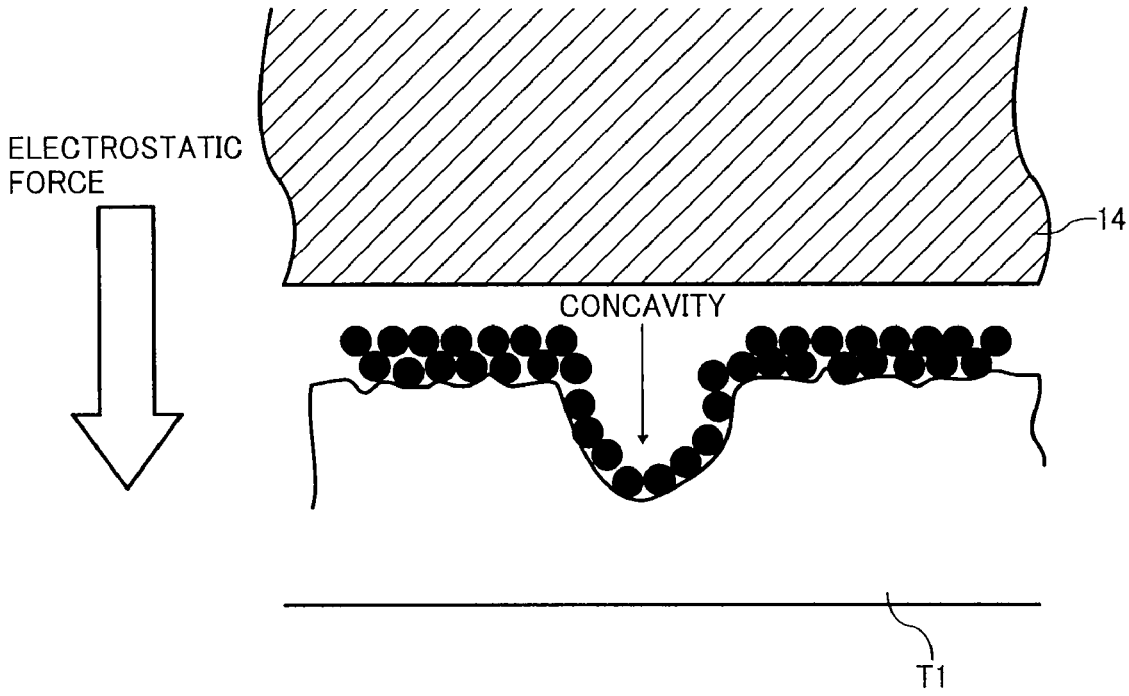
FIG. 6B is a schematic view illustrating a state of the portions shown in FIG. 6A just after transfer.

FIGS. 6A and 6B are schematic views illustrating portions near the concavities of the transfer sheet and the photoreceptor drum 14 when the patch of a filled-in image is transferred from the photoreceptor drum 14 to a transfer sheet (transfer material) T1, in the image forming apparatus according to the present embodiment.

FIG. 6A shows the state just before the transfer process, and FIG. 6B shows the state after the transfer process.

Figure 10A:
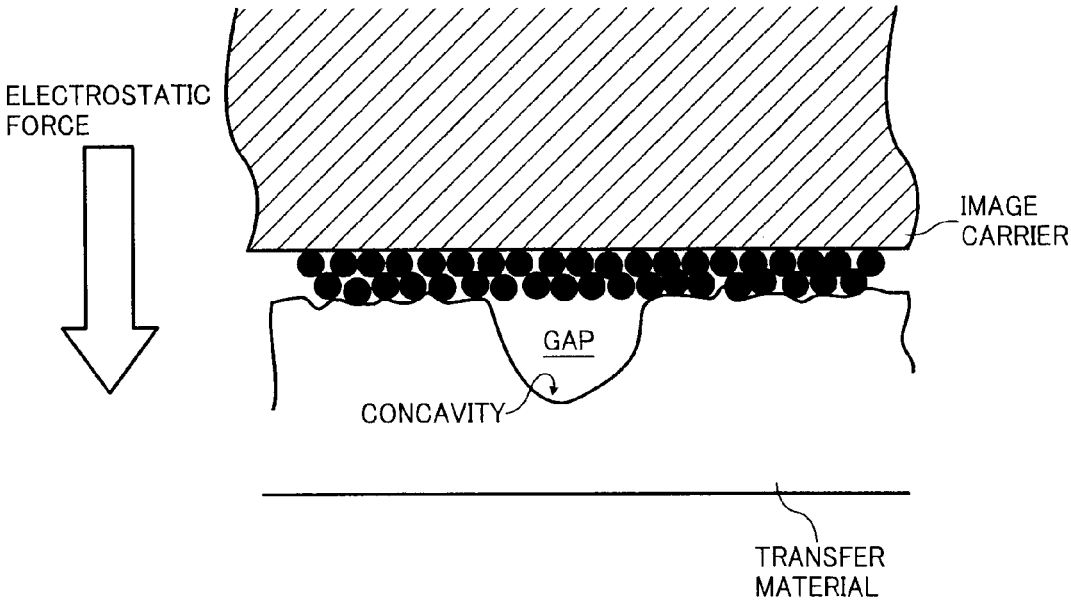
FIG. 10A RELATED ART
FIG. 10A is a schematic view illustrating a state of portions near concavities of a transfer sheet and a photoreceptor drum just before a patch of a filled-in image is transferred from a photoreceptor drum onto the transfer sheet in a known image forming apparatus.
Figure 10B:
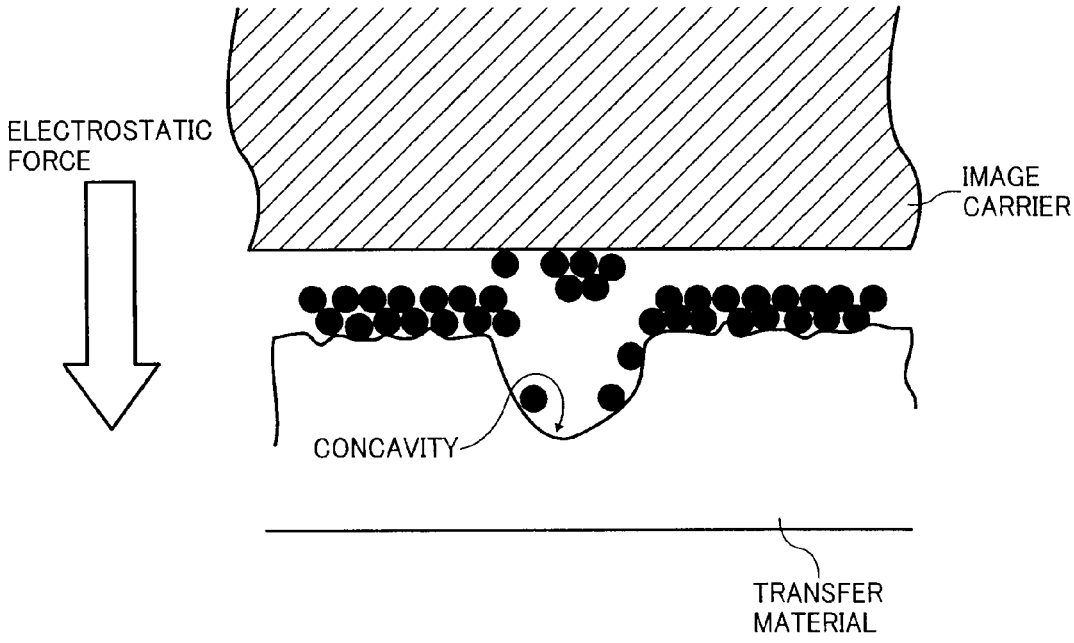
FIG. 10B RELATED ART
FIG. 10B is a schematic view illustrating a state of the portions shown in FIG. 6A just after transfer.

When compared with FIG. 10A described in the background section, in FIG. 6A, it is obvious that the toner in the concavities is closer to the transfer material.

Thus, it is envisioned that the toner can be attracted to the transfer material even in the concavities because the electrostatic force by the transfer bias can work.

Therefore, by adjusting the exposure amount to increase the toner adhesion amount, the gap between the toner (developer) in the concavities and the transfer material can be reduced, and thus, transfer properties can be enhanced by preventing electricity from discharging.

That is, as shown in FIG. 6B, by adjusting the exposure amount, the toner adhesion amount in the concavities can be increased, and the toner can be attracted to even concavities on the transfer material, which inhibits occurrence of image failure such as a nonsmooth image, if the transfer material that has surface with markedly uneven, that has deep concavities, is used.

(Control of the Transfer Bias)

The control mechanism 43 that adjusts the transfer bias by obtaining feedback of the asperity profile is described below.

(1) Measurement of the Asperities in the Main Scanning Direction

Similarly to the process of the position detection of the concavities, initially, the asperity profile across the entire width of the transfer material is acquired at one time using the laser displacement gauge S1, and then the asperity profile is stored in the storage mechanism 41.

(2) Calculation of a Depth Mean Value in the Main Scanning Direction

Subsequently, the calculation mechanism 42 calculates the mean value of depths of the surface of the transfer material based on the asperity profile, and then the depth mean value is set as a reference surface, that is an average line.

(3) Calculation of the Parameter that Represents the Surface Roughness of the Transfer Material.

By the calculation mechanism 42, the parameters such as, ten-point mean roughness (Rz) and an arithmetical mean roughness (Ra), both according to JIS B 0601 (1994), is calculated.

The "ten-point mean roughness (Rz)" is obtained as follows: Initially, a given portion having a length l in the direction of the average line (hereinafter "average line direction") is extracted as a sample from the cross-sectional profile (asperity profile) of the transfer material, which is hereinafter referred to as "extracted portion", and five highest peaks and five lowest valleys in the extracted portion are identified. Then, an average of absolute values of "profile peak heights (Yp)" that are measured as heights of the five highest peaks from the average line in vertical direction (depth direction), and an average of absolute values of "profile valley depth (Yv)" that are measured as depths of the lowest valleys from the average line in vertical direction are calculated. Then, a sum of these averages is expressed in micrometers (μm).

The "arithmetical mean roughness (Ra)" is obtained as follows: Similarly, a given portion having a length l in the average line direction is extracted from the cross-sectional profile (asperity profile) of the transfer material. In the extracted portion, when an X-axis is in the average line direction, and a Y-axis is in the in vertical direction, and the roughness profile is expressed as y=f(x), the arithmetical mean roughness (Ra) is a value in micrometers (μm) calculated by formula 1 shown below.

$$Ra = \frac{1}{l}\int_0^l |f(x)|dx \qquad \text{(Formula 1)}$$

It is to be noted that the parameters representing the surface roughness are not limited to the ten-point mean roughness (Rz) and arithmetical mean roughness (Ra), but also any parameter that is an indicator is applicable. For example, such a parameter can be obtained by calculating the standard deviation from the average line of the asperity profile in the depth direction.

(4) Determination of Type of the Transfer Material

The type of the transfer material is determined in accordance with the value of the parameter calculated by the above-described calculation mechanism 42.

(5) Determination of the Transfer Bias

In advance, optimal transfer bias is classified according to types of the transfer material and is stored in the storage mechanism as a database. Then, referring to the database, the reference value of the optimal transfer material is set in accordance with the type of the transfer material determined as described above.

(Control of the Toner Adhesion Amount and the Transfer Bias When the Toner is Degraded)

Descriptions will be given below of the control of the toner adhesion amount and the transfer bias performed when the charge amount of the developer (toner) does not reach the predetermined range because of the toner deterioration.

Generally, when the charge amount of the developer is reduced, image density unevenness, in other words, the image failure tends to be result. Particularly when the rough material such as Japanese paper is used for printing, image density unevenness is frequently generated.

Then, in the present embodiment, when a parameter representing the asperities exceeds a predetermined reference value, which can be prescribed in advance, for example, when the ten-point mean roughness (Rz) as such a parameter is exceeds 10 μm, the transfer material is determined as a rough material.

At that time, the toner adhesion amount is set to an amount smaller than the reference value when the image density is adjusted in the process control. Additionally, in the case described above, the control mechanism 43 sets the voltage of the transfer bias to a value lower than the reference value stored in the storage mechanism 42. "The transfer bias is lower than the reference value" means that the transfer bias is adjusted by the control mechanism 43 so that the absolute value of the transfer current or the transfer voltage is lower than the absolute value of the reference value (plus or minus).

Further, it can be determined that the toner has deteriorated when, for example, the number of rotations of the development roller or the photoreceptor drums, the travel distance of the development roller or the photoreceptor drums, the amount of toner consumption, number of the transfer material output by the image forming apparatus, or the elapsed time in days from when the toner cartridge is exchanged, is greater than a reference value.

It is to be noted that the reference value can be set by experimentally obtaining a threshold of a parameter above or below which charge amount of the developer is out of the desired range. For this purpose, the threshold value of, for example, an outside coating rate of the toner, toner particle roundness, and/or toner particle diameter, can be used.

(Control of the Toner Adhesion Amount and the Transfer Bias Performed Shortly After the Toner Cartridge is Exchanged)

Descriptions will be given below of the control of the toner adhesion amount and transfer bias performed when charge amount of the developer exceeds the predetermined range because the toner is new, for example, shortly after the toner cartridge is exchanged.

In contrast to deteriorated toner, when the toner is new, the charge amount of the developer is increased and image density unevenness tends to be caused in a low image density area. Similarly to the above-described case, when the rough material such as Japanese paper is used for printing, image density unevenness is frequency generated.

Then, in the present embodiment, when a parameter representing the asperities exceeds a predetermined reference value, which can be prescribed in advance, for example, when the ten-point mean roughness (Rz) as such a parameter exceeds 10 μm, the transfer material is determined as a rough material having large asperities in the above-described determination process of a type of the transfer material.

At that time, the toner adhesion amount is set to an amount larger than the reference value when the image density is adjusted in the process control. Additionally, in the case described above, the control mechanism 43 sets the voltage of the transfer bias to a value higher than the reference value stored in the storage mechanism 42.

Further, it can be determined that the toner is new when, for example, the number of rotations of the development roller or the photoreceptor drums, the travel distance of the development roller or the photoreceptor drums, the amount of toner consumption, number of the transfer material output by the image forming apparatus, or the elapsed time in days from when the toner cartridge is exchanged, is smaller or shorter than a reference value.

It is to be noted that the reference value can be set by obtaining a threshold of a parameter at which charge amount of the developer decrease to the desired range in experiments.

The threshold value of, for example, outside coating rate of the toner, toner particle roundness, and/or toner particle diameter, can be used.

As described above, in the first embodiment of the present invention, the image forming apparatus includes the asperity profile reading mechanism that reads the asperity profile of an entire image area in the width direction of the transfer material, and the toner adhesion amount is adjusted in accordance with the localized asperities in the asperity profile of the surface of the transfer material read by the reading mechanism. Therefore, the control mechanism can inhibit image failure such as image density unevenness by reading the localized asperities of the transfer material.

Additionally, the amount of the toner adhesion is not increased in portions where such adjustment is not necessary. As a result, the color reproducibility in an entire image transferred onto the transfer material can increase, and also toner consumption can be reduced.

Moreover, because the exposure amount can be adjusted only by varying the laser power, the control of the toner adhesion mount can be facilitated.

Further, the asperity profile reading mechanism determines the types of the transfer material and controls the transfer bias according to transfer material type. As a result, as compared with a case in which the user selects to adjust on the panel, the adjustment can be performed more securely and more finely without errors. Thus, the image quality of the transferred image can be improved.

In addition, the transfer bias and the toner adhesion amount can be adjusted in accordance with condition of the toner, deteriorated or new, and thus, the image quality of the transfer image can be further improved.

Second Embodiment

A second embodiment of the present invention that is a variation example of the first embodiment is described below. One difference from the first embodiment is that an image forming apparatus according to the second embodiment includes a specular-reflection-type optical sensor S2, not shown, instead of the laser displacement gauge S1, shown in FIG. 3, that is a dispersion-reflection type optical sensor. However, other elements are similar and thus the description thereof is omitted.

The specular-reflection type optical sensor S2 includes a light-emitting diode (LED) that is a light-emitting element serving as a laser light source, and a photodiode or a charge coupled device (CCD) that is a receiving element (the photodiode is more preferable).

In the optical sensor S2, when the light emitting diode LED emits a laser light, the photodiode or the CCD receives the light specular-reflected on surface of the transfer material, and the amount of light thus received is measured and stored.

Further, similarly to the first embodiment, the optical sensor S2 is disposed so that the optical sensor S2 can direct light toward that portion of the transport belt 30 shown in FIG. 2 which is wound around the outer circumference of the driving roller 31 so as to scan a surface of the transfer material when the transfer material carried on the transfer belt 30 passes the driving roller 31. This is done in order to reduce the impact of vibration of the belt on the measurement readings.

Although the optical sensor S2 cannot obtain the cross-sectional profile as the laser displacement gauge S1 does, the optical sensor S2 still can detect concavities through a method described below instead of the position detection process described in first embodiment.

In the present embodiment, the calculation mechanism can calculate an average amount of the light received by the photodiode or CCD (hereinafter "received light average amount"). When the amount of the received light at a measured position is smaller than the received light average amount by a predetermined amount (for example, 10%), the measured position is deemed a concavity.

Then, similarly to the first embodiment, in the present embodiment, by changing the power level of the laser source of the optical unit 2 shown in FIG. 2 from a normal power level (for example, 150 μW) to a higher power level used for the concavities (for example, 250 μW), the toner adhesion amount in the portion determined as the concavities is increased.

Therefore, the image-forming apparatus can inhibit image failure, such as image density unevenness, that is caused by localized concavities of the transfer material while attaining both sufficient color repeatability and reduction in the toner consumption.

Furthermore, the concavities can be detected more accurately regardless of the type of the transfer material. Particularly when the photodiode is used, the body of image forming apparatus can be smaller and the cost of the apparatus can be reduced.

Third Embodiment

An image forming apparatus according of a third embodiment is described below with reference to FIGS. 7 through 9. A difference from the first embodiment is that the image forming apparatus of the present embodiment uses a scanner S3 that is a manuscript reader as an asperity profile reading mechanism instead of the laser displacement gauge S1, which is not provided. A description of the remainder of the configuration is omitted as redundant.

Figure 7:
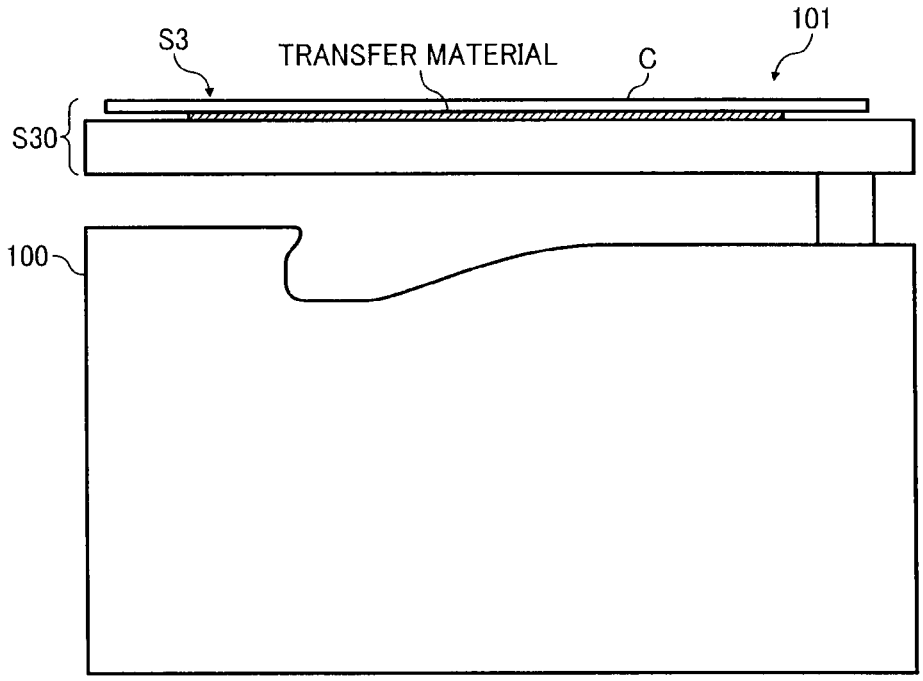
FIG. 7 is a schematic diagram illustrating an image forming apparatus according to another illustrative embodiment of the present invention.

FIG. 7 is a schematic diagram illustrating the image forming apparatus according to the third embodiment.

In FIG. 7, reference numeral 101 indicates one example of the image forming apparatus that in the present embodiment is a MFP (Multifunction Peripheral) connected to the scanner S3 (manuscript reader), serving as the asperity profile reading mechanism, that includes a manuscript-reading device S30 provided with a cover C.

In the multifunction peripheral 101, the scanner S3 that is the manuscript reader is located above the multicolor printer 100 according to the first embodiment.

Figure 8:
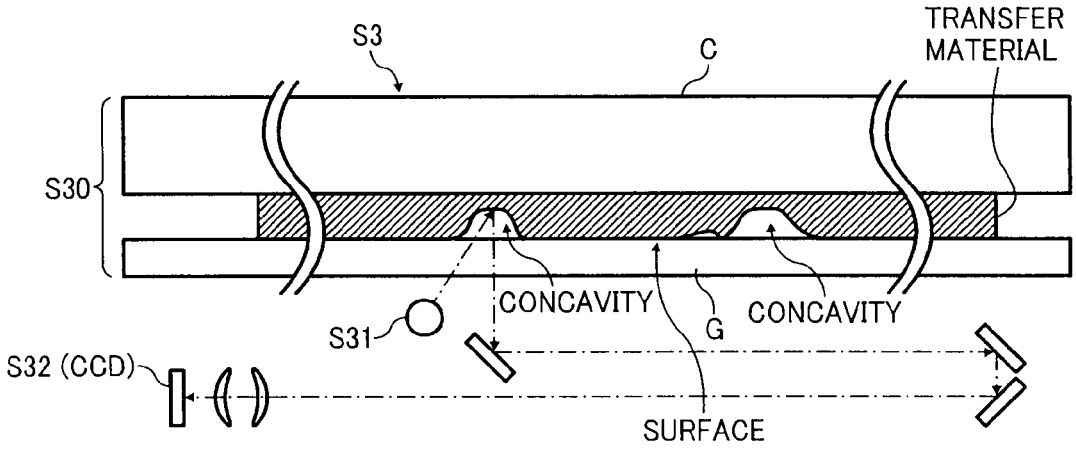
FIG. 8 illustrates a configuration of a scanner shown in FIG. 7.
Figure 9:
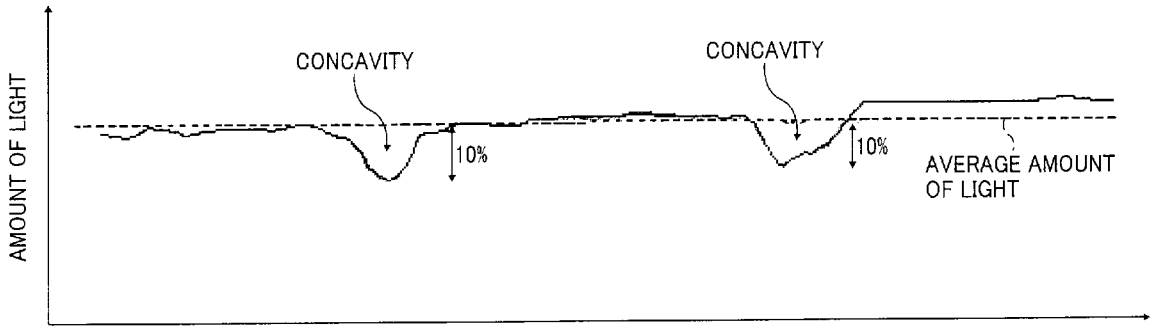
FIG. 9 is a graph illustrating one example of an asperity profile of a transfer material read by the scanner shown in FIG. 8.

FIG. 8 illustrates a configuration of the scanner S3, and FIG. 9 is a graph illustrating s asperity profile of the transfer material read by the scanner 3.

Referring to FIG. 8, the scanner S3 includes the manuscript-reading device S30 that is composed of the cover C and a contact glass G, a fluorescence tube S31 that is a light source, and an electrical-charge transfer element (hereinafter also "CCD") S32 that is a light-receiving element.

In the scanner S3, the fluorescence tube S31 emits light that is reflect off the surface of the transfer material when the transfer material is set with its front surface down in the manuscript-reading device S30. Then, the light specularly reflected on the front surface of the transfer material is reflected by the mirrors to the CCD S32. Consequently, the CCD S32 receives the light, and the amount of light thus received is measured and stored.

FIG. 9 illustrates an asperity profile without image correction, which is generally performed when the reading mechanism is used. In FIG. 9, a vertical axis shows an amount of received light, and a horizontal axis shows measured position on the transfer material.

Referring to FIG. 9, similarly to the above-described variation example, in the present embodiment, the calculation mechanism can calculate an average amount of light received by the electrical-charge transfer element S32, and when the amount of the received light at the measured position is smaller than the received light average amount by a predetermined amount (for example, 10%), the measured position is deemed a concavity.

Similarly to the first embodiment, the image forming apparatus according to the present embodiment is designed to increase the toner adhesion amount by changing the power level of the laser source for the optical unit 2 shown in FIG. 1 from a normal power level (for example, 150 μW) to a higher power level used for the concavities (for example, 250 μW), in which the toner adhesion amount in the portion determined as the concavities is increased.

When the transfer material whose asperity profile is read by the manuscript reader S30 is set in the sheet feeder or manual feeder so that an image is transferred onto a surface (front surface) whose asperity profile is read by the scanner S3, the scanner S3 can be used as an asperity profile reading mechanism.

Therefore, the image forming apparatus can prevent image failure such as image density unevenness resulting from localized asperities of the transfer material, without a separate asperity profile reading mechanism.

In addition, the overall color reproducibility is good, and also the toner consumption can be reduced. Therefore, the cost of the apparatus can be reduced.

It is to be noted that although a quadruplet tandem-type direct transfer multicolor printer is described above as the image forming apparatus according to the various embodiments of the present invention, an image forming apparatus according to in the present specification is not limited to the above-described direct transfer type and/or quadruplet tandem type, is also applicable to an intermediate transfer-type and/or single-color-image forming apparatus that includes only a single photoreceptor drum.

In short, the present invention is applicable to any image forming apparatus as long as that image forming apparatus includes an asperity profile reading mechanism and is designed to control the toner adhesion amount in accordance with localized asperities in the asperity profile of the surface of the transfer material read by the asperity profile reading mechanism.

Further, although as an asperity profile reading mechanism the optical sensor is described above, other types of sensor are also applicable as long as that sensor can measure the asperity of an entire image area of the transfer material at least in its width direction, and positions of concavities can be determined by a calculation mechanism. For example, as an asperity profile reading mechanism, an eddy-current gauge, an ultrasound gauge, a laser focus gauge, and contacting gauge can be used.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an exposure mechanism to form a latent image by exposure;

a latent-image carrier to carry the latent image;

a charging mechanism to charge the latent-image carrier evenly;

a development device to develop a latent image on the latent-image carrier into a toner image;

a transfer mechanism to transfer the toner image formed on the latent-image carrier onto a transfer material;

at least one asperity profile reading mechanism to read an asperity of an entire image area of the transfer material at least in a width direction of the transfer material onto which a toner image is to be transferred; and a control mechanism to adjust a toner adhesion amount of the toner image transferred to the transfer material in accordance with a localized asperity of a surface of the transfer material read by the asperity profile reading mechanism, such that more toner is transferred at a local area of the transfer material where there is a bigger asperity relative to a local area of the transfer material where there is a smaller asperity.

2. The image forming apparatus according to claim 1, wherein the control mechanism adjusts the toner adhesion amount in accordance with the localized asperity of the surface of the transfer material by varying an amount of exposure light emitted from the exposure mechanism.

3. The image forming apparatus according to claim 1, further comprising:

a storage mechanism to store an asperity profile; and a calculating mechanism to perform predetermined calculation based on the asperity profile stored in the storage mechanism and determine a type of the transfer material, wherein the storage mechanism stores data of a reference value for one of a transfer current and a transfer voltage preliminarily set for each type of the transfer material in accordance with the type of the transfer material, and the one of the transfer current and the transfer voltage is set to the reference value selected from the data in the storage mechanism according to the type of the transfer material determined by a calculation result obtained by the calculating mechanism.

4. The image forming apparatus according to claim 3, wherein the calculation mechanism calculates a parameter representing a degree of surface roughness of the transfer material, and the control mechanism sets the toner adhesion amount to an amount smaller than a reference set value in image density adjustment and sets the absolute value of one of the transfer current and the transfer voltage to an amount lower than the absolute value of the reference value when the parameter calculated by the calculation mechanism exceeds a predetermined value and the toner has deteriorated.

5. The image forming apparatus according to claim 3, wherein, the calculation mechanism calculates a parameter representing a degree of surface roughness of the transfer material, and when the parameter is greater than a predetermined value and the toner is new, the control mechanism sets the toner adhesion amount to an amount higher than a reference set value in image density adjustment, and sets the absolute value of one of the transfer current and the transfer voltage to an amount higher than the absolute value of the reference value.

6. The image forming apparatus according to claim 1, wherein the asperity profile reading mechanism is a reflective optical sensor.

7. The image forming apparatus according to claim 6, wherein the reflective optical sensor detects a leading edge position of the transfer material.

8. The image forming apparatus according to claim 6, wherein a light source of the reflective optical sensor is a semiconductor laser.

9. The image forming apparatus according to claim 6, wherein a light source of the reflective optical sensor is a light-emitting diode.

10. The image forming apparatus according to claim 1, wherein the asperity profile reading mechanism is a manuscript reader to scan a manuscript.

11. The image forming apparatus according to claim 1, wherein the control mechanism is to adjust the toner adhesion amount such that more toner is transferred in a local area of the transfer material where there is a concavity relative to a local area of the transfer material where there is no concavity.

12. A control method for an image forming apparatus including an asperity profile reading mechanism, a storage mechanism, and a calculating mechanism, the control method comprising:

reading an asperity profile of a transfer material at least in a width direction of a transfer material onto which a toner image is to be transferred; and adjusting a toner adhesion amount of the toner image transferred to the transfer material in accordance with a localized asperity in the asperity profile of a surface of the transfer material, such that more toner is transferred at a local area of the transfer material where there is a bigger asperity relative to a local area of the transfer material where there is a smaller asperity.

13. The control method according to claim 12, further comprising:

adjusting the toner adhesion amount in accordance with the localized asperity of the surface of the transfer material by varying an amount of exposure light emitted from an exposure mechanism.

14. The control method according to claim 12, further comprising:

storing data of a reference value for one of a transfer current and a transfer voltage preliminarily set for each type of the transfer material in accordance with the type of the transfer material;

storing an asperity profile in the storage mechanism;

performing predetermined calculation based on the asperity profile stored in the storage mechanism and determining a type of the transfer material; and setting the one of the transfer current and the transfer voltage to a reference value selected from the data according to the type of the transfer material.

15. The control method according to claim 14, further comprising:

calculating a parameter representing a degree of surface roughness of the transfer material;

setting the toner adhesion amount to an amount smaller than a reference set value in image density adjustment in the control mechanism and the absolute value of one of the transfer current and the transfer voltage to an amount lower than the absolute value of the reference value when the calculated parameter exceeds a predetermined value and the toner has deteriorated.

16. The control method according to claim 14, further comprising:

calculating a parameter representing a degree of surface roughness of the transfer material; and when the parameter is greater than a predetermined value and the toner is new, setting the toner adhesion amount to an amount higher than a reference set value in image density adjustment the control mechanism and the absolute value of one of the transfer current and the transfer voltage to an amount higher than the absolute value of the reference value in the control mechanism.

17. The control method according to claim 12, wherein the adjusting of the toner adhesion amount adjusts the toner adhesion amount such that more toner is transferred in a local area of the transfer material where there is a concavity relative to a local area of the transfer material where there is no concavity.

* * * * *